United States Patent [19]

Kawabata et al.

[11] Patent Number: 4,689,594

[45] Date of Patent: Aug. 25, 1987

[54] MULTI-LAYER CHIP COIL

[75] Inventors: Toshio Kawabata, Uji; Kunisaburo Tomono, Kyoto, both of Japan

[73] Assignee: Murata Manufacturing Co., Ltd., Japan

[21] Appl. No.: 906,095

[22] Filed: Sep. 10, 1986

[30] Foreign Application Priority Data

Sep. 11, 1985 [JP] Japan ..... 60-202462

[51] Int. Cl.[4] ..... H01F 5/00; H01F 27/28

[52] U.S. Cl. ..... 336/200; 336/225

[58] Field of Search ..... 336/200, 222, 223, 225; 29/602 R, 606

[56] References Cited

U.S. PATENT DOCUMENTS 3,765,082 10/1973 Zyetz ..... 336/200 X
4,543,553 9/1985 Mandai et al. ..... 336/200 X

FOREIGN PATENT DOCUMENTS 3022347 12/1981 Fed. Rep. of Germany ..... 336/200
57-100209 of 1982 Japan .
96710 6/1983 Japan ..... 336/200

*Primary Examiner*—Thomas J. Kozma
*Attorney, Agent, or Firm*—Ostrolenk, Faber, Gerb & Soffen

[57] ABSTRACT

A multi-layer chip coil which comprises a stack of intermediate laminas of magnetizeable material having a through-hole defined therein so as to extend completely through the thickness thereof, first and second patterned electric conductors formed on the opposite surfaces of each of the intermediate laminas, respectively, and an electroconductive element extending through the through-hole so as to connect the first and second conductors together. The intermediate laminas are stacked one above the other with the first and second conductors in one intermediate lamina partially overlapping in contact with the second conductor in the neighboring intermediate lamina immediately thereabove and the first conductor in the neighboring intermediate lamina immediately therebelow, respectively, whereby the first and second conductors in all of the intermediate laminas, which are connected in series with each other through the respective conductive element, are connected in series with each other.

3 Claims, 6 Drawing Figures

MULTI-LAYER CHIP COIL

BACKGROUND OF THE INVENTION

1. Field of Technology

The present invention generally relates to a subminiature coil assembly and, more particularly, to a multi-layer chip coil comprised of a stack of magnetizeable laminas having respective patterned conductors connected electrically in series with each other in a substantially zigzag fashion.

2. Description of the Prior Art

The multi-layer chip coil, precisely speaking, a laminated chip inductor, of a type generally comprised of a stack of magnetizeable laminas having respective patterned conductors formed thereon and connected electrically in series with each other in substantially zigzag fashion is disclosed in, for example, Japanese Laid-open Utility Model Publication No. 57-100209. This prior art multi-layer chip inductor is substantially reproduced in FIGS. 1 and 2 of the accompanying drawings for the purpose of detailed discussion of the prior art considered pertinent to the present invention, reference to which will now be made.

Referring to FIG. 1 showing the multi-layer chip inductor in exploded view, the prior art multi-layer chip inductor comprises a pair of generally rectangular outermost laminas 1 and 1' of magnetizeable material, each having first and second surfaces opposite to each other, and a plurality of intermediate laminas 2 of magnetizeable material stacked one above the other and firmly sandwiched between the outermost laminas 1 and 1', each of said intermediate laminas 2 having first and second surface opposite to each other. Only the first surfaces of the intermediate laminas 2 are respectively formed with generally U-shaped electric conductors 3, each opening towards one of the opposite ends of the associated intermediate lamina 2 and having its opposite ends 3*a* and 3*b* both terminating at a portion of the associated intermediate lamina 2 generally intermediate of the length thereof.

Each of the intermediate laminas 2 has defined therein a through-hole 4 extending completely through the thickness of the respective intermediate lamina 2 while opening at one end through one end 3*a* of the associated U-shaped conductor 3, which through-hole 4 has been formed by perforating the respective intermediate lamina 2 across the thickness thereof so as to leave a cylindrical wall coaxial with such through-hole 4. As best shown in FIG. 2 which illustrate the neighboring intermediate laminas in side sectional view, each cylindrical wall defining the respective through-hole 4 is plated, or otherwise lined, with the same electroconductive material as that for any one of the U-shaped conductors 3 so as to provide a conductive bushing 5 having one end continued to the end 3*a* of the associated U-shaped conductor 3 and the other end terminating flush the second surface of the respective intermediate lamina 2.

The outermost lamina 1 has its first surface formed with a generally L-shaped electric conductor 6 including a lengthwise strip 6*a* extending along and adjacent to one side of the lamina 1 and terminating at a portion thereof generally intermediate of the length of the lamina 1, and a lateral strip 6*b* continued to the lengthwise portion 6*a* and extending along one end thereof for electric connection with an end cap or like terminal member (not shown). Similarly, the outermost lamina 1' has its first surface formed with a generally L-shaped electric conductor 6' including a lengthwise strip 6'*a* extending along and adjacent to one side of the lamina 1' and terminating at a portion thereof generally intermediate of the length of the lamina 1', and a lateral strip 6'*b* continued to the lengthwise strip 6'*a* and extending along one end thereof for electric connection with another end cap or like terminal member (not shown). The outermost laminas 1 and 1' are similar in structure to each other except that only the outermost lamina 1' is formed with a through-hole 4' so as to extend completely through the thickness thereof while opening at one end through a free end portion of the lengthwise strip 6'*a* in a manner similar to the through-hole 4 in any one of the intermediate laminas 2, the cylindrical wall defining the through hole 4' being similarly plated or lined with the same electroconductive material to provide a conductive bushing (not visible) which has one end continued to the lengthwise strip 6'*a* and the other end terminating flush with the second surface of the outermost lamina 1' in a manner similar to the conductive bushing 5 as shown in FIG. 2.

When assembling the laminas 1, 2 and 1' together to provide a substantially complete multi-layer chip inductor, the intermediate laminas 2 are stacked one above the other with all of the first surfaces thereof oriented in one and the same direction while one intermediate lamina 2 is turned 180° about the imaginary common axis, extending through all of the intermediate laminas 2 at right angles thereto, relative to the next adjacent intermediate lamina 2 positioned immediately thereabove or therebelow whereby the perforated end 3*a* of the conductor 3 in such one intermediate lamina 2 is aligned, and connected electrically through the associated conductive bushing 5, with the non-perforated end 3*b* of the conductor 3 in such next adjacent intermediate lamina 2. With respect to the outermost laminas 1 and 1', the laminas 1 and 1' are turned 180° about the imaginary common axis referred to above, relative to each other, where the number of the intermediate laminas 2 is of an even-numbered value such as shown, so that the conductor 6 on the lamina 1 held in contact with the neighboring intermediate lamina 2 can be electrically connected with the conductor 3 on such neighboring lamina 2 through the conductive bushing 5 and, similarly, the conductor 6' on the lamina 1' held in contact with the neighboring intermediate lamina 2 farthest from the lamina 1 can be electrically connected with the conductor 3 on such lamina 2 farthest from the lamina 1 through the conductive bushing in the through-hole 4'.

In the assembled condition, since the first surface of only the outermost lamina 1' where the conductor 6' is formed is laid bare and exposed to the outside, a cover plate 7 similar in material and shape to any one of the laminas 1, 2 and 1' is placed over the outermost lamina 1' to conceal the conductor 6'.

All of these laminas including the cover plate are in practice clamped together, and the stack is then baked, or otherwise heat-treated, followed by the connection to terminal electrodes (not shown) to the respective opposite ends of the stack in electrically connected relationship with the strips 6*b* and 6'*b* on the associated outermost laminas 1 and 1'.

Thus, in the prior art multi-layer chip inductor, the conductors 3 on the respective intermediate laminas 2 and the conductors 6 and 6' on the respective outermost laminas 1 and 1' are connected electrically in series with each other through the conductive bushings 5 connecting the perforated end 3*a* of the conductor 3 on one intermediate lamina with the non-perforated end 3*b* of the conductor 3 on the neighboring intermediate lamina positioned therebelow while the conductive strip 6*a* of the conductor 6 on the outermost lamina 1 is connected with the perforated end 3*a* of the conductor 3 on the intermediate lamina 2 immediately thereabove through the conductive bushing 5 and the conductive strip 6'*a* of the conductor 6' on the outermost lamina 1' is connected with the non-perforated end 3*b* of the conductor 3 on the intermediate lamina 2 immediately therebelow through the conductive bushing in the through-hole 4'.

It has, however, been found that the prior art chip inductor of the construction shown in and described with reference to FIGS. 1 and 2 has the following problem. Specifically, where the wall thickness of the conductive bushing 5 situated inside each through-hole 4 or 4' is small, it often happens that some or all of the conductive bushings tend to evaporate and diffuse during the heat-treatment and the series connection of these conductors consequently breaks down.

In order to avoid the above mentioned problem, it is known to form each conductive bushing 5 plated, or otherwise lined, with another similar conductive bushing 5' as shown in FIG. 3 with one end of the conductive bushing 5' adjacent the second surface of the respective lamina 2 or 1' allowed to spread radially outwardly therefrom for facilitating a positive contact of the perforated end 3*a* of the conductor 3 or the conductive strip 6'*a* in one lamina with the non-perforated end 3*b* of the conductor 3 or the conductive strip 6*a* in the next adjacent lamina immediately therebelow. The use of the double-walled conductive bushing in each of the laminas such as shown in FIG. 3 brings about such a disadvantage that since areas of electric series connection of the conductors are concentrated around the respective through-holes 4 and 4' and since the wall thickness of each double-walled bushing is increased, some or all of the magnetizeable laminas as well as some or all of the through-holes tend to be deformed when the stack is clamped, and/or any possible shortcircuiting is about to occur during the use which would result in the breakdown of the chip inductor.

SUMMARY OF THE INVENTION

The present invention has been developed with a view to substantially eliminating the above described problems and has for its essential object to provide an improved multi-layer chip coil easy to manufacture in compact size and reliable in performance with the minimized possibility of circuit breakdown.

In order to accomplish the object of the present invention, the present invention makes use of a plurality of intermediate laminas each made of magnetizeable material and having its opposite first and second surfaces formed with first and second patterned conductors. The first and second patterned conductors in each intermediate lamina are electrically connected with each other through a conductive busing plated or lined to the wall defining a through-hole in the respective intermediate lamina so as to extend completely through the thickness thereof, said conductive bushing having its opposite ends that are continued to the first and second patterned conductors.

When the intermediate laminas are stacked one above the other, the first and second conductors in one intermediate lamina partially overlap the second conductor in the neighboring intermediate lamina immediately thereabove and the first conductor in the neighboring intermediate lamina immediately therebelow, respectively. Thus, the conductors in all of the intermediate laminas are electrically connected in series with each other by the direct partial contact between the first and second conductors in one lamina and the second and first conductors in the different neighboring laminas.

The outermost laminas used in the present invention, which are made of the same magnetizeable material as that for the intermediate laminas, have respective conductors formed on one surface thereof in a shape similar to that shown in FIG. 1. However, neither the through-hole nor the conductive bushing are formed in any one of the outermost laminas used in the present invention, however, the conductor in one of the outermost laminas is allowed to partially contact the second conductor in the intermediate lamina immediately thereabove while the conductor in the other of the outermost lamina is allowed to partially contact the first conductor in the intermediate lamina immediately therebelow.

The structure according to the present invention ensures the firm electric series connection of the conductors and also minimizes the possibility of shortcircuiting and/or circuit breakdown even when the stack is baked or otherwise heat treated.

BRIEF DESCRIPTION OF THE DRAWINGS

This and other objects and features of the present invention will be readily understood from the following description taken in conjunction with a preferred embodiment with reference to the accompanying drawings, in which.

DETAILED DESCRIPTION OF THE EMBODIMENT

Figure 4:
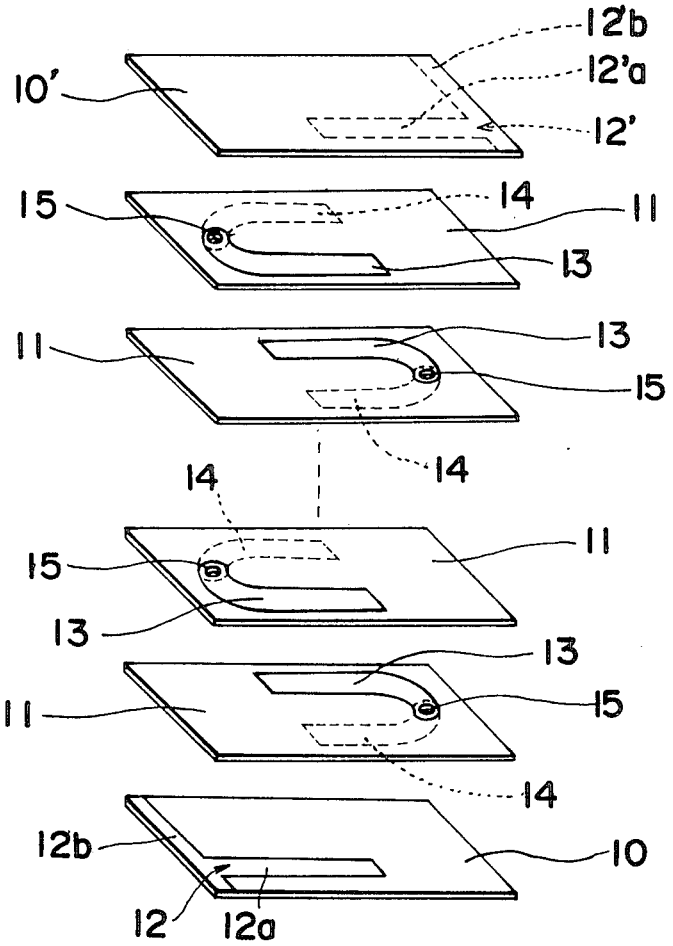
FIG. 4 is an exploded view of a multi-layer chip coil embodying the present invention.
Figure 5:
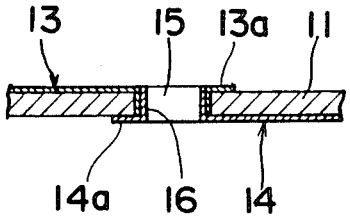
FIG. 5 is a side sectional view of one of intermediate laminas used in the present invention showing an electric connection between first and second conductors.
Figure 6:
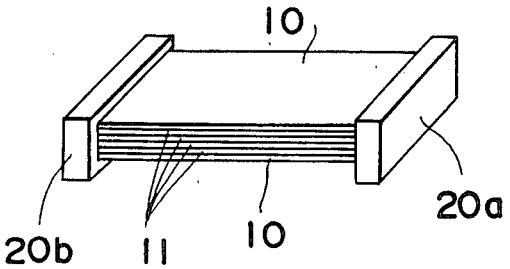
FIG. 6 is a schematic perspective view of the multi-layer chip coil ready for actual use.

Referring now to FIGS. 4 to 6, a multi-layer chip coil comprises a pair of generally rectangular outermost laminas 10 and 10' each having first and second surfaces opposite to each other, and a plurality of, for example, four, intermediate laminas 11 similar in shape to the outermost laminas 10 and 10' each having first and second surfaces opposite to each other. All of these laminas 10, 10' and 11 are made of magnetizeable material, which may be selected from the group consisting of, for example, Ni-Zn ferrite, Ni-Cu-Zn ferrite, Ng-Zn ferrite and Cu-Zn ferrite, and stacked one above the other with the first surfaces of all of the laminas oriented in one and the same direction and with the intermediate laminas 11 firmly sandwiched between the outermost laminas 10 and 10'. The stack of the laminas 10, 10' and 11 has its opposite ends capped with respective terminal members 20*a* and 20*b*, shown in FIG. 6, for electric connection with external circuit wirings.

The outermost lamina 10 has a generally L-shaped conductor 12 formed on the first surface thereof, which conductor 12 is comprised of a lengthwise conductive strip 12*a*, extending along and adjacent to one side thereof and terminating at a portion thereof generally intermediate of the length of the lamina 10, and a lateral conductive strip 12*b* continued to the lengthwise conductive strip 12*a* and extending along one end thereof for electric connection with the terminal member 20*b*. The outermost lamina 10' has a similar, generally L-shaped conductor 12' composed of lengthwise and lateral conductive strips 12'*a* and 12'*b*, it being, however, to be noted that the conductor 12' is formed on the second surface of the outermost lamina 10' and is offset 180° in position relative to the conductor 12 on the outermost lamina 10 about an imaginary axis passing intermediately between the outermost laminas 10 and 10' in a direction widthwise of the stack.

The intermediate laminas 11 are of identical construction, and therefore, reference will now be made to only one of them for the sake of brevity in describing the details thereof. As best shown in FIG. 4, the intermediate lamina has its first and second surfaces formed with first and second generally J-shaped conductors 13 and 14, respectively, in such a manner that, when the respective shapes of the first and second conductors 13 and 14 are combined together, they can generally represent the shape of a figure "U". More specifically, a bent end 13*a* of the first conductor 13 overlap with a bent end 14*a* of the second conductor 14 with the intervention of the intermediate lamina 11 and is electrically connected thereto through a double-layered bushing 16 passing through a through hole 15 defined in the intermediate lamina 11 as best shown in FIG. 5. It is to be noted that the conductive bushing 16 in each through-hole 15 formed in the intermediate laminas 11 used in the present invention is not used to connect any one of the conductors 13 and 14 in one intermediate lamina 11 with that in the neighboring intermediate lamina 11 positioned thereabove or therebelow, but merely serves to connect the conductors 13 and 14 in each intermediate lamina 11 together.

The double-layered conductive bushing 16 in each intermediate lamina 11 may be formed by the use of any suitable method. For example, a method can be employed wherein, when an electroconductive material is printed on the first surface of each intermediate lamina 11 to form the conductor 13, the electroconductive material being printed is sucked so as to flow into the respective through-hole 15 while plating the peripheral wall defining the through-hole 15 thereby to form the inner layer of the conductive bushing 16, followed by the repetition of a similar procedure during the formation of the conductor 14 on the second surface thereby to form the outer layer of the bushing 15 in overlapping relation to the inner layer thereof. This method has been effective to ensure a firm and rigid electric connection between the conductors 13 and 14 in each intermediate lamina 11.

The electroconductive material for the conductors, including those on each intermediate lamina 11 and those on the outermost laminas 10 and 10', may be silver, an Ag-Pd alloy, or the like.

When the intermediate laminas 11, each being of the construction as hereinabove described, are stacked one above the other and then sandwiched between the outermost laminas 10 and 10' to complete the multi-layer chip coil, each of the neighboring intermediate laminas 11 are held in such a relationship wherein, while the first surfaces of the respective intermediate laminas 11 orient in one and the same direction, for example, upwards as viewed in FIG. 4, one lamina 11 is turned endwise relative to the next adjacent lamina 11 so that one end of the conductor 13 remote from the through-hole 15 in such one lamina 11 can overlap and contact one end of the conductor 14 remote from the through-hole 15 in the lamina 11 positioned immediately thereabove whereas one end of the conductor 14 remote from the through-hole 15 in such one lamina 11 can overlap and contact one end of the conductor 13 remote from the through-hole 15 in the lamina positioned immediately thereabove. In other words, the intermediate laminas 11 are alternately turned endwise so that the configuration of the conductors 13 and 14 in one lamina 11 can oppose that in the next adjacent lamina 11 positioned immediately above or below such one lamina 11.

To the stack of the intermediate laminas 11, the outermost lamina 10 is applied with the lengthwise conductive strip 12*a* of the conductor 12 partially overlapping and contacting the end of the conductor 14 remote from the through-hole 15 in the intermediate lamina 11 positioned immediately thereabove, and the outermost lamina 10' is applied with the lengthwise conductive strip 12'*a* of the conductor 12' partially overlapping and contacting the end of the conductor 13 remote from the through-hole 15 in the intermediate lamina 11 positioned immediately therebelow. This assembly is then baked, or heat-treated, followed by the painting of an electroconductive material to the opposite ends thereof to complete the respective terminal members 20*a* and 20*b* which are electrically connected with the lateral conductive strips 12'*b* and 12*b* in the associated outermost laminas 10' and 10.

From the foregoing description of the preferred embodiment of the present invention, it has now become clear that all of the conductors 13 and 14 are electrically connected in series with each other while the series connected conductors 13 and 14 in each intermediate lamina 11 substantially corresponds to half the turn of a well-known wire coil.

Although the present invention has fully been described in connection with the preferred embodiment thereof with reference to the accompanying drawings, it is to be noted that various changes and modifications are apparent to those skilled in the art. By way of example, not only the number of the intermediate laminas, but also the shape of each conductor in each lamina and/or the position of the through-hole in each lamina may not be always limited to those shown and described.

Also, each intermediate layer has been described as having on its opposite surface the first and second conductors of a total length corresponding generally to half the turn of the wire coil, the conductors in each intermediate lamina may have any desired total length within the range of half the turn of the wire coil to one turn thereof.

Figure 1:
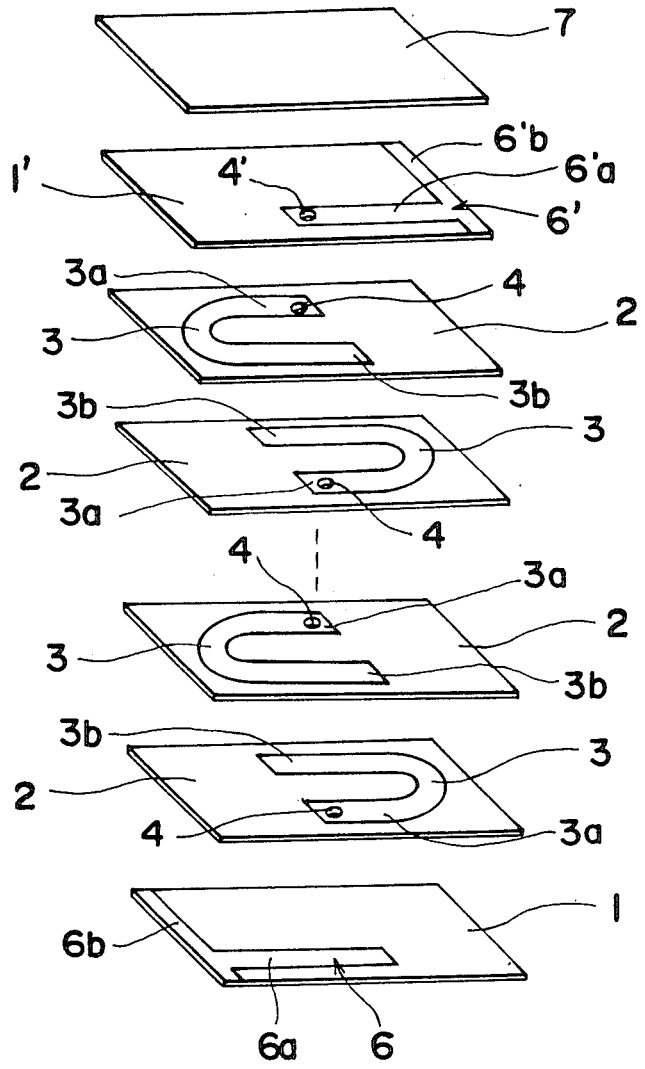
Fig. 1 Prior Art
FIG. 1 is an exploded view of the prior art multi-layer chip inductor.
Figure 2:
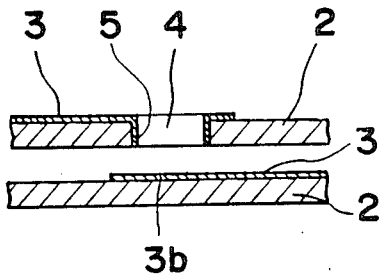
Fig. 2 Prior Art
FIG. 2 is a sectional view of the neighboring intermediate laminas used in the prior art multi-layer chip inductor of FIG. 1 shown in spaced relation to each other.
Figure 3:
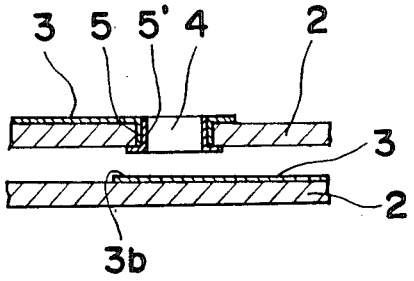
Fig. 3 Prior Art
FIG. 3 is a view similar to FIG. 2, showing the use of the double-walled conductive bushing according to the different prior art.

If desired, one or two cover plates made of the same material as that for any one of the laminas, which functionally correspond to the cover plate 7 shown in FIG. 1 and used in the prior art multi-layer chip coil, may be employed on one or both sides of the assembly including the stack of the intermediate laminas sandwiched between the outermost laminas.

Accordingly, such changes and modifications are to be understood as included within the scope of the present invention unless they depart therefrom.

What is claimed is:

1. A multi-layer chip coil which comprises a stack of intermediate laminas each made of magnetizeable material and having first and second surfaces opposite to each other, each of said intermediate laminas having a through-hole defined therein so as to extend completely through the thickness thereof; first and second patterned electric conductors formed on the first and second surfaces of each of the intermediate laminas, respectively, and an electroconductive element extending through the through-hole so as to connect the first and second patterned conductors in each intermediate lamina together, said intermediate laminas being stacked one above the other with the first and second conductors in one intermediate lamina partially overlapping in contact with the second conductor in the neighboring intermediate lamina immediately thereabove and the first conductor in the neighboring intermediate lamina immediately therebelow, respectively, whereby the first and second conductors in all of the intermediate laminas, which are connected in series with each other through the respective conductive element, are connected in series with each other.

2. The chip coil as claimed in claim 1, wherein the magnetizeable material is selected from the group consisting of Ni-Zn ferrite, Ni-Cu-Zn ferrite and Mg-Zn ferrite.

3. The chip coil as claimed in claim 2, wherein each of the first and second conductors in each intermediate lamina is of a generally elongated shape, said first and second conductors altogether representing a generally U-shaped configuration.

* * * * *